US011345056B1

(12) United States Patent
Wang

(10) Patent No.: US 11,345,056 B1
(45) Date of Patent: May 31, 2022

(54) SHAVING RAZOR

(71) Applicant: NOTO-TECH ELECTRONICS CO., LIMITED, Hong Kong (CN)

(72) Inventor: Wenxuan Wang, Shenzhen (CN)

(73) Assignee: NOTO-TECH ELECTRONICS CO., LIMITED, Hong Kong (CN)

( * ) Notice: Subject to any disclaimer, the term of this patent is extended or adjusted under 35 U.S.C. 154(b) by 0 days.

(21) Appl. No.: 17/537,539

(22) Filed: Nov. 30, 2021

(30) Foreign Application Priority Data

Nov. 3, 2021 (CN) ..... 202122674862.0

(51) Int. Cl.
*B26B 21/52* (2006.01)
*B26B 21/14* (2006.01)

(52) U.S. Cl.
CPC ..... *B26B 21/521* (2013.01); *B26B 21/14* (2013.01); *B26B 21/522* (2013.01)

(58) Field of Classification Search
USPC ..... D28/48; 30/47–51, 526–536
See application file for complete search history.

(56) References Cited

U.S. PATENT DOCUMENTS

D135,044 S * 2/1943 Buller ..... D28/48
4,083,103 A * 4/1978 Estandian ..... B26B 21/52 30/47
4,409,735 A * 10/1983 Cartwright ..... B26B 21/4031 30/47
4,879,811 A * 11/1989 Cooney ..... B26B 21/52 30/527
D355,049 S * 1/1995 Yasui ..... D28/48
6,266,888 B1 * 7/2001 Zowaski ..... B26B 21/523 30/526
D463,622 S * 9/2002 Harrington ..... D28/48
6,598,303 B2 * 7/2003 Bosy ..... B26B 21/52 30/526
6,615,498 B1 * 9/2003 King ..... B26B 21/521 30/527
6,854,188 B1 * 2/2005 Wonderley ..... B26B 21/225 30/527
6,877,227 B2 * 4/2005 Santhagens Van Eibergen ..... B26B 21/227 30/34.2
7,086,160 B2 * 8/2006 Coffin ..... B26B 21/4006 30/527
7,140,116 B2 * 11/2006 Coffin ..... B26B 21/225 30/529
D563,047 S * 2/2008 Ramm ..... D28/48
D575,903 S * 8/2008 Wakayama ..... D28/48
D585,157 S * 1/2009 Park ..... D28/48
7,526,869 B2 * 5/2009 Blatter ..... B26B 21/225 30/527

(Continued)

*Primary Examiner* — Jason Daniel Prone
(74) *Attorney, Agent, or Firm* — Benjamin H. B. Sley

(57) ABSTRACT

A shaving razor, includes a handle assembly, a blade holder assembly and at least one blade set, where the handle assembly is connected with the blade holder assembly, the blade holder assembly includes a blade holder body, an accommodation groove is formed in the blade holder body, the at least one blade set is embedded into the accommodation groove, and a discharge port is formed at the bottom of the accommodation groove. With the discharge port in the blade holder body of the shaving razor, the shaved hair can fall out of the discharge port and is discharged timely, thereby preventing accumulated hair from affecting the use.

7 Claims, 7 Drawing Sheets

(56) References Cited

U.S. PATENT DOCUMENTS

D611,654 S * 3/2010 Nakasuka ..... D28/48
7,685,720 B2 * 3/2010 Efthimiadis ..... B26B 21/38 30/527
D646,436 S * 10/2011 Furuta ..... D28/48
D651,345 S * 12/2011 Micinilio ..... D28/48
D659,287 S * 5/2012 Psimadas ..... D28/48
8,191,263 B2 * 6/2012 Follo ..... B26B 21/44 30/538
8,205,344 B2 * 6/2012 Stevens ..... B26B 21/225 30/526
D668,817 S * 10/2012 Psimadas ..... D28/48
8,484,852 B2 * 7/2013 King ..... B26B 21/225 30/34.2
8,590,162 B2 * 11/2013 Park ..... B26B 21/225 30/526
8,650,763 B2 2/2014 Howell et al.
8,732,965 B2 * 5/2014 Efthimiadis ..... B26B 21/521 30/526
8,745,883 B2 * 6/2014 Murgida ..... B26B 21/521 30/527
8,789,282 B2 * 7/2014 Wilson ..... B26B 21/14 83/698.21
8,793,880 B2 8/2014 Taub et al.
D730,579 S * 5/2015 Han ..... D28/48
9,390,631 B2 7/2016 Romeu
9,469,038 B2 * 10/2016 Iaccarino ..... B26B 21/521
9,694,503 B2 * 7/2017 Papadopoulos-Papageorgis ..... B26B 21/14
9,707,688 B2 * 7/2017 Giannopoulos ..... B26B 21/521
9,757,870 B2 * 9/2017 Giannopoulos ..... B26B 21/225
D808,589 S * 1/2018 Dryfhout ..... D28/48
D819,889 S * 6/2018 Lyles ..... D28/48
10,486,321 B2 * 11/2019 Gratsias ..... B26B 21/225
D870,970 S * 12/2019 Dubin ..... D28/48
10,850,412 B2 * 12/2020 Harris, II ..... B26B 21/521
11,007,661 B2 * 5/2021 Mazarakis ..... B26B 21/521
2002/0104223 A1 * 8/2002 Oldroyd ..... B26B 21/225 30/527
2005/0241162 A1 * 11/2005 Nicolosi ..... B26B 21/225 30/531
2006/0196054 A1 * 9/2006 Luxton ..... B26B 21/4025 30/50
2006/0277769 A1 * 12/2006 Coffin ..... B26B 21/222 30/527
2009/0293292 A1 * 12/2009 Ramm ..... B26B 21/522 30/526
2011/0088269 A1 * 4/2011 Walker, Jr ..... B26B 21/225 30/527
2011/0271534 A1 * 11/2011 Briganti ..... B26B 21/523 30/535
2012/0279070 A1 * 11/2012 Seo ..... B26B 21/4056 30/34.2
2013/0019484 A1 * 1/2013 Allen ..... B26B 21/523 30/526
2013/0160306 A1 * 6/2013 Howell ..... B26B 21/225 30/527
2014/0150264 A1 * 6/2014 Micinilio ..... B26B 21/522 30/41
2014/0190013 A1 * 7/2014 Coviello ..... B26B 21/4081 30/47
2015/0283716 A1 * 10/2015 Kim ..... B26B 21/225 30/526
2016/0151924 A1 * 6/2016 Gers-Barlag ..... B26B 21/522 30/526
2016/0250764 A1 * 9/2016 Hashimoto ..... B26B 21/521 30/47
2016/0263758 A1 * 9/2016 Wilson ..... B26B 21/225
2017/0334081 A1 * 11/2017 Dryfhout ..... B26B 21/44
2021/0069922 A1 * 3/2021 Han ..... B26B 21/225
2021/0086381 A1 * 3/2021 Avery ..... B26B 21/522
2021/0122072 A1 * 4/2021 Ntavos ..... B26B 21/225
2021/0129365 A1 * 5/2021 Kopelas ..... B26B 21/4062
2021/0187769 A1 * 6/2021 Kopelas ..... B26B 21/225
2021/0283792 A1 * 9/2021 Lee ..... B26B 21/40
2021/0354321 A1 * 11/2021 Kopelas ..... B26B 21/521
2021/0354322 A1 * 11/2021 Kopelas ..... B26B 21/225
2021/0379782 A1 * 12/2021 Kim ..... B26B 21/521
2022/0009115 A1 * 1/2022 Ren ..... B26B 21/521
2022/0016794 A1 * 1/2022 Jang ..... B26B 21/526

* cited by examiner

SHAVING RAZOR

CROSS-REFERENCE TO RELATED APPLICATIONS

This application claims priority to Chinese Patent Application No. 202122674862.0 with a filing date of Nov. 3, 2021. The content of the aforementioned application, including any intervening amendments thereto, is incorporated herein by reference.

TECHNICAL FIELD

The present application relates to the field of shaving devices, and in particular, to a shaving razor.

BACKGROUND

With the social progress, hair removal has been popular to people, not only for aesthetically pleasing appearance, but also for health because excessive hair is unfavorable for toxin elimination from the skin and causes the unpleasant odor. Presently, the hair removal is more common to women, and some men also perform the hair removal for their thick beards. A shaving razor is one of main tools for the hair removal. However, after the long-term use, the blade of the shaving razor is not sharp enough and cannot shave hair effectively. The blade of the existing shaving razor is changed under the help of auxiliary tools, with the troublesome operation. Moreover, the shaved hair cannot be discharged timely, and excessive accumulation of the hair in the blade holder assembly will affect the normal use of the shaving razor.

In view of this, there is an urgent need to overcome the shortages of the product in the prior art.

SUMMARY

A technical problem to be solved mainly by the present application is to provide a shaving razor. With the discharge port in the blade holder body of the shaving razor, the shaved hair can fall out of the discharge port and is discharged timely, thereby preventing accumulated hair from affecting the use.

In view of the above technical problem, the present application uses the following technical solutions: A shaving razor is provided, including a handle assembly, a blade holder assembly and at least one blade set, where the handle assembly is connected with the blade holder assembly, the blade holder assembly includes a blade holder body, an accommodation groove is formed in the blade holder body, the at least one blade set is embedded into the accommodation groove, and a discharge port is formed at the bottom of the accommodation groove.

The present application has the following beneficial effects: With the discharge port in the blade holder body of the shaving razor, the user can apply an external force to the blade set through the discharge port, such that the blade set is separated from the accommodation groove, thereby changing the blade set. In addition, the shaved hair can fall out of the discharge port and is discharged timely, thereby preventing accumulated hair from affecting the use.

DETAILED DESCRIPTION OF THE EMBODIMENTS

The technical solutions in the embodiments of the present application are clearly and completely described below with reference to the accompanying drawings in the embodiments of the present application. Apparently, the described embodiments are merely some rather than all of the embodiments of the present application. All other embodiments obtained by a person of ordinary skill in the art based on the embodiments of the present application without creative efforts should fall within the protection scope of the present application.

In the description of the present application, it should be understood that the orientations or position relationships indicated by terms "central", "longitudinal", "transverse", "length", "width", "thickness", "upper", "lower", "front", "rear", "left", "right", "vertical", "horizontal", "top", "bottom", "inner", "outer", and the like are orientations or position relationships shown based on the accompanying drawings, for ease of describing the present application and simplifying the description only, rather than indicating or implying that the indicated device or element must have a particular orientation or be constructed and operated in a particular orientation. Therefore, these terms cannot be construed as a limitation to the present application. Moreover, the terms such as "first" and "second" are used only for the purpose of description and should not be construed as indicating or implying a relative importance, or implicitly indicating a quantity of indicated technical features. Thus, features defined with "first" and "second" may explicitly or implicitly include one or more of the features. In the description of the present application, "multiple" means two or more, unless otherwise specifically defined.

Figure 1:
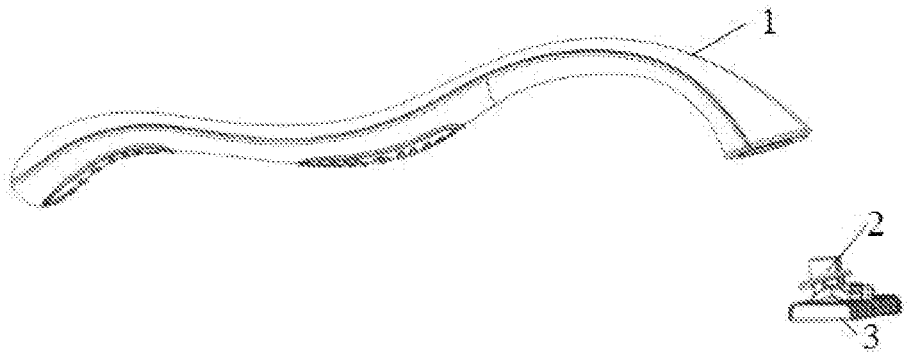
FIG. 1 is a schematic structural view of a shaving razor according to an embodiment of the present application.

Referring to FIG. 1, the embodiment provides a shaving razor. The shaving razor includes a handle assembly 1, a blade holder assembly 2 and at least one blade set 3, where the handle assembly 1 is connected with the blade holder assembly 2, and the at least one blade set 3 is provided on the blade holder assembly 2. The number of blade sets 3 is not specifically defined, and can be provided as the case may be. For example, there may be two blade sets 3, and may also be four blade sets 3.

In actual use, the user holds the handle assembly 1 and applies an external force to the handle assembly 1, such that the blade set 3 on the blade holder assembly 2 moves to shave the hair.

Figure 2:
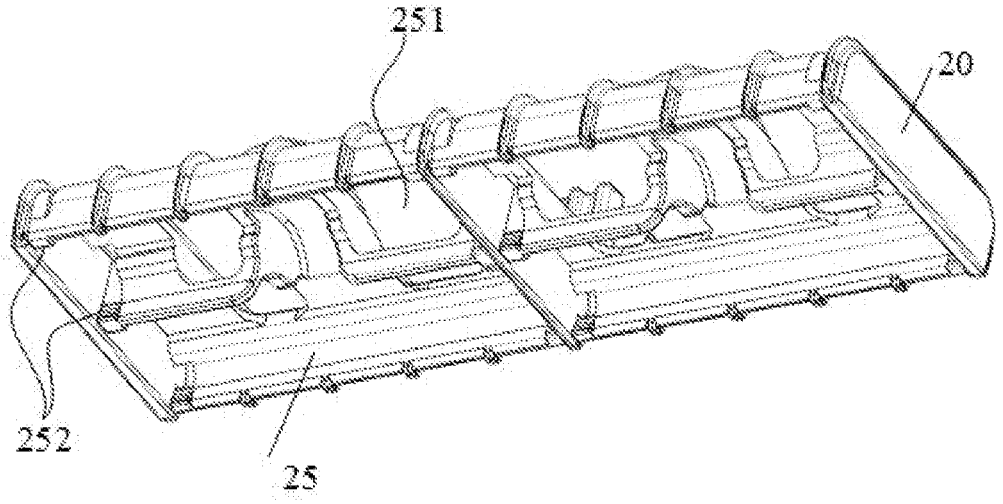
FIG. 2 is a schematic structural view of a blade holder assembly according to an embodiment of the present application.

Referring to FIG. 2, an accommodation groove 25 is formed in the blade holder body 20, the at least one blade set is embedded into the accommodation groove 25, a side of the accommodation groove 25 close to the handle assembly is provided with a discharge port 251, and the shaved hair is discharged through the discharge port 251.

In addition, the external force may further be applied to the blade set through the discharge port 251, such that the blade set is separated from the accommodation groove 25.

In the embodiment, the discharge port 251 may be a square discharge port 251, a circular discharge port 251 or a discharge port 251 of another shape, provided that a part of the blade set is exposed out on a back side of the blade holder body 20; and in this case, the user may apply the external force to the blade set through the discharge port 251, such that the blade set is separated from the accommodation groove 25, thereby changing the blade set.

In addition, the shaved hair can fall out of the discharge port 251 and is discharged timely, thereby preventing accumulated hair from affecting the use.

Further, at least two engageable portions 252 are arranged on the accommodation groove 25, the at least two engageable portions 252 are opposite to each other, and the engageable portions 252 each is configured to fix the blade set on the blade holder body 20. The engageable portions 252 each may be made of an elastic material. The accommodation groove 25 is of a rectangular shape. The engageable portions 252 may be respectively provided on two opposite sides of the accommodation groove 25 to stably fix the blade set on the blade holder body 20.

In a preferred embodiment, four engageable portions 252 are arranged on the accommodation groove 25, and the engageable portions 252 are arranged at four corners of the accommodation groove 25, respectively. Such a structure yields a higher stability because it fixes the blade set from the four corners.

In the embodiment, there are four accommodation grooves 25, and four blade sets. The four accommodation grooves 25 are arranged in a "field" shape, and adjacent accommodation grooves 25 share the corresponding sidewall.

Figure 3:
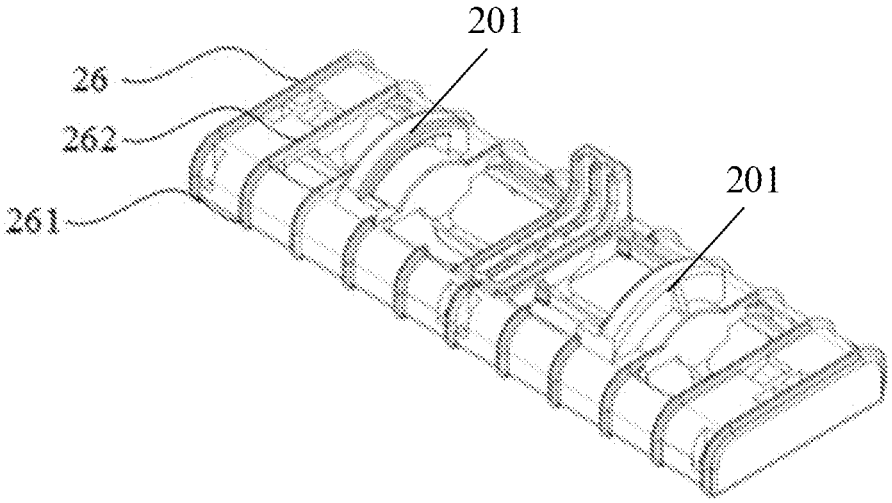
FIG. 3 is a schematic structural view of another blade holder assembly according to an embodiment of the present application.
Figure 4:
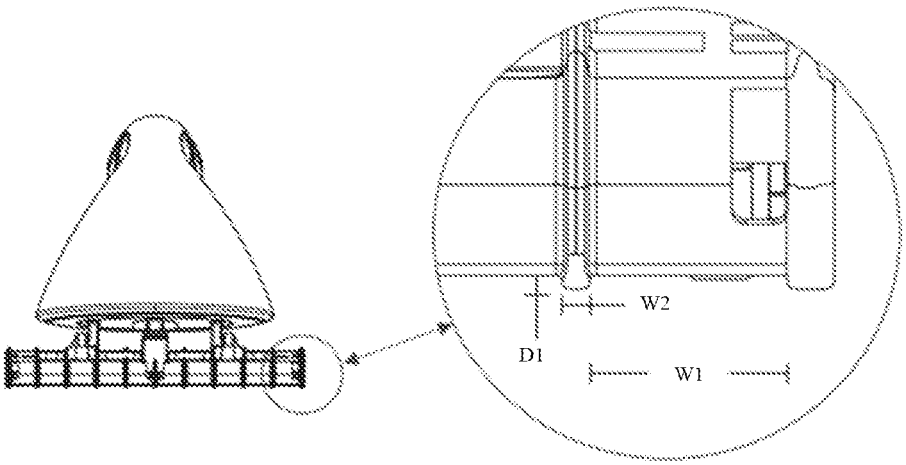
FIG. 4 is a schematic structural view of still another blade holder assembly according to an embodiment of the present application.

In the embodiment, the blade holder body 20 has a length of 87.5 mm±1 mm, and a width of 30.5 mm±1 mm. Referring also to FIG. 3 and FIG. 4, the blade set 3 is provided on the blade holder body 20; and multiple protective convex ribs 26 are arranged on an outer surface of the blade holder body 20, the protective convex ribs 26 are distributed at intervals along a length direction of the blade holder body 20, the protective convex ribs 26 each extend along a width direction of the blade holder body 20, and an end portion 261 of each of the protective convex ribs 26 is protruded out of an edge of the blade holder body 20. The end portion 261 of each of the protective convex ribs 26 is a spherical protrusion or an elliptical protrusion.

In the embodiment, the blade edge of the blade set 3 is perpendicular to the length direction of the blade holder body 20, and the end portion 261 of each of the protective convex ribs 26 is perpendicular to the blade edge of the blade set 3, which can prevent the blade from scraping skin during transverse movement and make the use comfortable and safe.

In the embodiment, the interval between adjacent protective convex ribs 26 is the same. Certainly, the interval between adjacent protective convex ribs 26 may also be different, and may be set as the case may be.

In a specific embodiment, as shown in FIG. 4, the interval W1 between center lines of adjacent protective convex ribs 26 is 8.6 mm±1 mm, the end portion 261 of each of the protective convex ribs 26 has a maximum width W2 of 1 mm±0.5 mm, and the end portion 261 of each of the protective convex ribs 26 has a protruded distance D1 of 0.5 mm±0.2 mm relative to the blade holder body 20.

In the embodiment, the blade holder body 20 has a length of 87.5 mm±1 mm, and a width of 30.5 mm±1 mm.

In actual applications, the protective convex rib 26 located at an edge of the blade holder body 20 includes a transition portion 262 and two end portions 261, the two end portions 261 are arranged on two sides of the blade holder assembly 2, the transition portion 262 extends along the surface of the blade holder body 20, two ends of the transition portion 262 are respectively connected with the two end portions 261, and a plane where each of the end portions 261 is located is parallel to a plane where the blade set 3 is located. The transition portion 262 of the protective convex rib 26 located on a middle of the blade holder body 20 is cut off by other structures.

In the embodiment, the protective convex ribs 26 further dress and fix the hair to make the hair shaved more conveniently.

The foregoing descriptions mainly introduce the structure of the blade holder assembly. Hereinafter, the structure of the handle assembly will be described in combination with FIG. 5.

Figure 5:
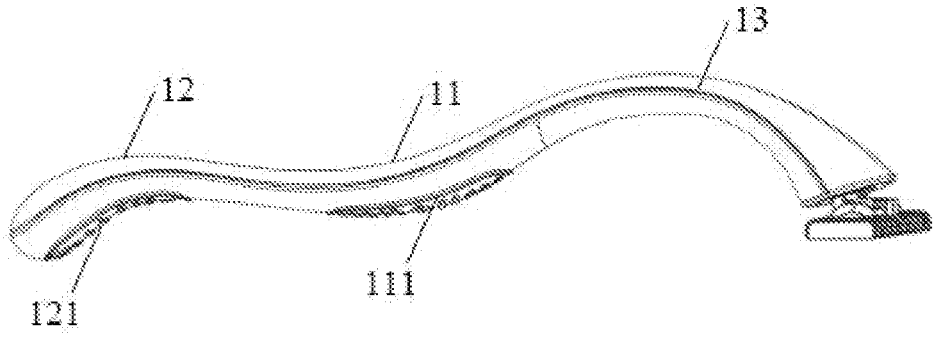
FIG. 5 is a schematic structural view of a handle assembly according to an embodiment of the present application.

In the embodiment, the handle assembly 1 is designed in combination with the hand structure of the human body, which not only prolongs the handle, but also makes the shape of the handle ergonomic to facilitate operation of the user. Specifically, as shown in FIG. 5, the handle assembly 1 includes a first holding portion 11 and a second holding portion 12, the first holding portion 11 is located between the blade holder assembly 2 and the second holding portion 12, the first holding portion 11 and the second holding portion 12 each is of an arc shape, and opening directions of arcs corresponding to the first holding portion 11 and the second holding portion 12 are opposite to each other. The first holding portion 11 is a middle holding portion, and the second holding portion 12 is a tail holding portion.

In actual use, the user can selectively hold the first holding portion 11 or the second holding portion 12 according to the position of the hair to be shaved, thereby meeting shaving requirements at different positions. The first holding portion 11 is closer to the blade holder assembly 2, so when the position of the hair to be shaved is close to the hand, the first holding portion 11 can be selected for shaving operation; and when the position of the hair to be shaved is far away from the hand, the second holding portion 12 can be selected for shaving operation. Alternatively, the user can select the holding portion freely according to the habit in use.

The first holding portion 11 and the second holding portion 12 each is of the arc shape. In actual use, since people prefer holding the first holding portion 11 for shaving, a radius of curvature of the first holding portion 11 is greater than that of the second holding portion 12, which can ensure that a contact area between the first holding portion 11 and the hand is greater than that between the second holding portion 12 and the hand, thereby prolonging the handle without affecting the convenience and comfort in use.

Figure 6:
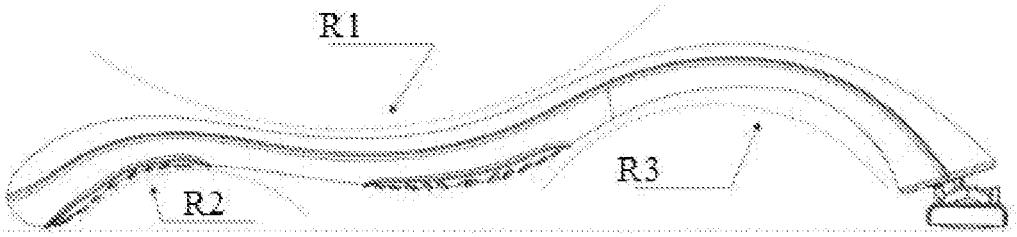
FIG. 6 is a schematic structural view of another handle assembly according to an embodiment of the present application.

Further, the handle assembly 1 further comprises a connecting portion 13, one end of the connecting portion 13 is connected with the blade holder assembly 2, the other end of the connecting portion 13 is connected with the first holding portion 11, the connecting portion 13 is of an arc shape, and opening directions of arcs corresponding to the connecting portion 13 and the first holding portion 11 are opposite to each other. The connecting portion 13 has a radius of curvature less than the radius of curvature of the first holding portion 11, but greater than the radius of curvature of the second holding portion 12. In a preferred embodiment, as shown in FIG. 6, according to the ergonomic design, the radius R1 of curvature of the first holding portion 11 is 175 mm±5 mm, the radius R2 of curvature of the second holding portion 12 is 60 mm±5 mm, and the radius R3 of curvature of the connecting portion 13 is 82.5 mm±5 mm. In actual use, when the radius of curvature of the first holding portion 11 is 175 mm, the radius of curvature of the second holding portion 12 is 60 mm, and the radius of curvature of the connecting portion 13 is 82.5 mm, thereby making the razor more convenient in use.

In addition, according to the foregoing design, without the external force, the end portion of the second holding portion 12 falls within the plane where the blade holder assembly 2 is located, thereby making the razor stored conveniently.

In a preferred embodiment, a first rough portion 111 is provided on the first holding portion 11, and a second rough portion 121 is provided on the second holding portion 12. Through the first rough portion 111 and the second rough portion 121, the frictional force between the hand and the holding portion is increased to facilitate the operation of the user. The first rough portion 111 and the second rough portion 121 each may be composed of multiple convex points or multiple convex ribs.

Figure 7:
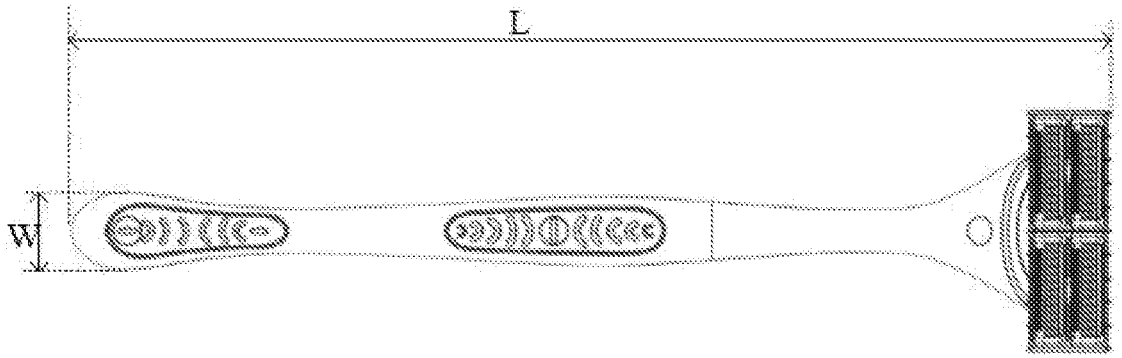
FIG. 7 is a schematic structural view of still another handle assembly according to an embodiment of the present application.

In the embodiment, as shown in FIG. 7, the end portion of the second holding portion 12 is a spherical protrusion or an elliptical protrusion or another irregular arc protrusion; the end portion of the second holding portion 12 has a maximum width W of 27.5 mm±2 mm; and a distance L between the end portion of the second holding portion 12 and the front end of the blade holder assembly 2 is 375 mm±5 mm.

In the embodiment, the connecting portion 13, the first holding portion 11 and the second holding portion 12 on the handle assembly 1 are in smooth transition connection to form a wavy shape. Therefore, in addition to the ergonomic design and convenience in operation, the product has the smooth line, compact size and aesthetic appearance.

Figure 8:
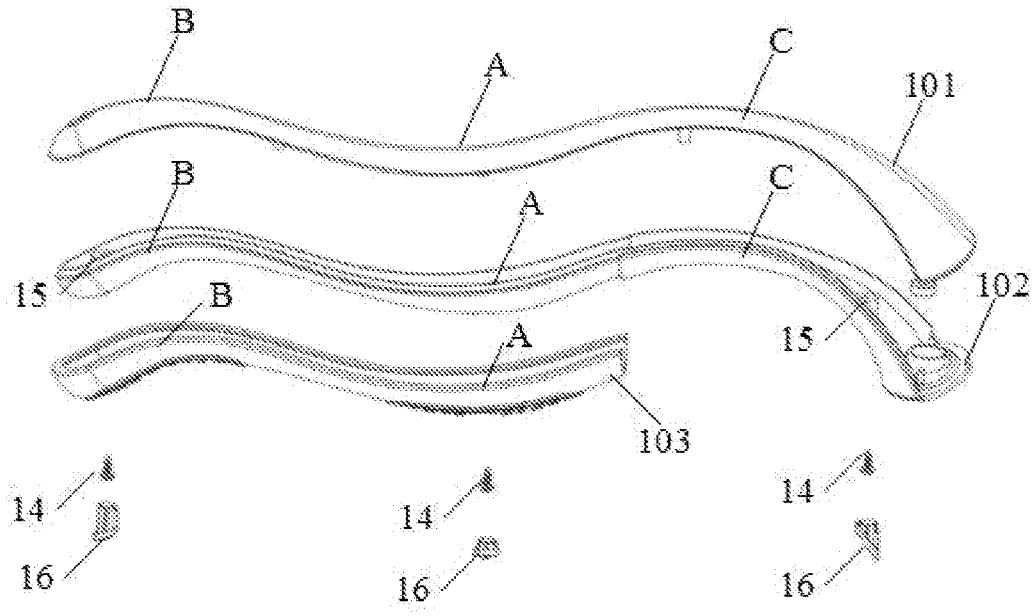
FIG. 8 is a schematic exploded view of a handle assembly according to an embodiment of the present application.

The internal structure of the handle assembly 1 will be specifically described in combination with FIG. 8. The handle assembly 1 includes a first shell 101, a second shell 102 and a third shell 103; the first shell 101 and the second shell 102 are basically the same in shape; and the third shell 103 is basically the same as a rear portion of each of the first shell 101 and the second shell 102 in shape. The first shell 101, the second shell 102 and the third shell 103 each is provided with a first arc segment A and a second arc segment B, where the first arc segment A on each shell is the same in shape, the second arc segment B on each shell is the same in shape, and opening directions of the first arc segment A and the second arc segment B are opposite to each other. In actual installation, two sides of the second shell 102 are respectively attached to the first shell 101 and the third shell 103, the first arc segments A on the first shell 101, the second shell 102 and the third shell 103 are formed into the first holding portion 11, and the second arc segments B on the first shell 101, the second shell 102 and the third shell 103 are formed into the second holding portion 12. The first shell 101 and the second shell 102 are made of a same material, while the third shell 103 is used for encapsulation.

In addition, the first shell 101 and the second shell 102 each is further provided with a third arc segment C, the third arc segment C on each shell is the same in shape, an opening direction of the third arc segment C is opposite to that of the first arc segment A, and the third arc segments C on the first shell 101 and the second shell 102 are formed into the connecting portion 13.

In the embodiment, the first rough portion 111 and the second rough portion 121 are arranged on the third shell 103, specifically, the first rough portion 111 is arranged on the first arc segment A, the second rough portion 121 is arranged on the second arc segment B, and the first rough portion 111 and the second rough portion 121 are arranged on a same surface of the third shell 103.

In the embodiment, the handle assembly 1 further includes at least one bolt 14, at least one bolt 14 hole is respectively formed in the first shell 101, the second shell 102 and the third shell 103, and the at least one bolt 14 passes through corresponding threaded holes 15 to fix the first shell 101, the second shell 102 and the third shell 103 together. The handle assembly 1 further includes a hole plug 16; and the hole plug 16 is provided outside the threaded hole 15 to hide the bolt 14, thereby making the product more aesthetic.

In order to ensure the structural stability of the product, there are three bolts 14 and three hole plugs 16; the first shell 101 and the second shell 102 each is provided with one threaded hole 15 at a tail end, a middle end and a front end, while the third shell 103 is provided with one threaded hole 15 at a tail end and a front end; and the threaded hole 15 at the tail end of the third shell 103 corresponds to the threaded hole 15 at the tail end of each of the first shell 101 and the second shell 102, the threaded hole 15 at the front end of the third shell 103 corresponds to the threaded hole 15 at the middle end of each of the first shell 101 and the second shell 102, and the bolts 14 sequentially pass through corresponding threaded holes 15 to fix the first shell 101, the second shell 102 and the third shell 103 together.

In order to prevent misalignment between the shells, a locating post is provided on the first shell 101, a locating hole is formed in the second shell 102, and the locating post is placed in the locating hole for locating.

In the embodiment, for ease of detachment of the blade holder assembly 2 from the handle assembly 1, a magnetic body is provided on the handle assembly 1 and/or the blade holder assembly 2, such that the blade holder assembly 2 is detachably fixed on the handle assembly 1 through a magnetic force.

In an optional embodiment, the handle assembly 1 is provided thereon with a first magnetic body, while the blade holder assembly 2 is provided thereon with a second magnetic body; and the first magnetic body and the second magnetic body are opposite in magnetism, such that the blade holder assembly 2 is fixed on the handle assembly 1 through the magnetic force.

Figure 9:
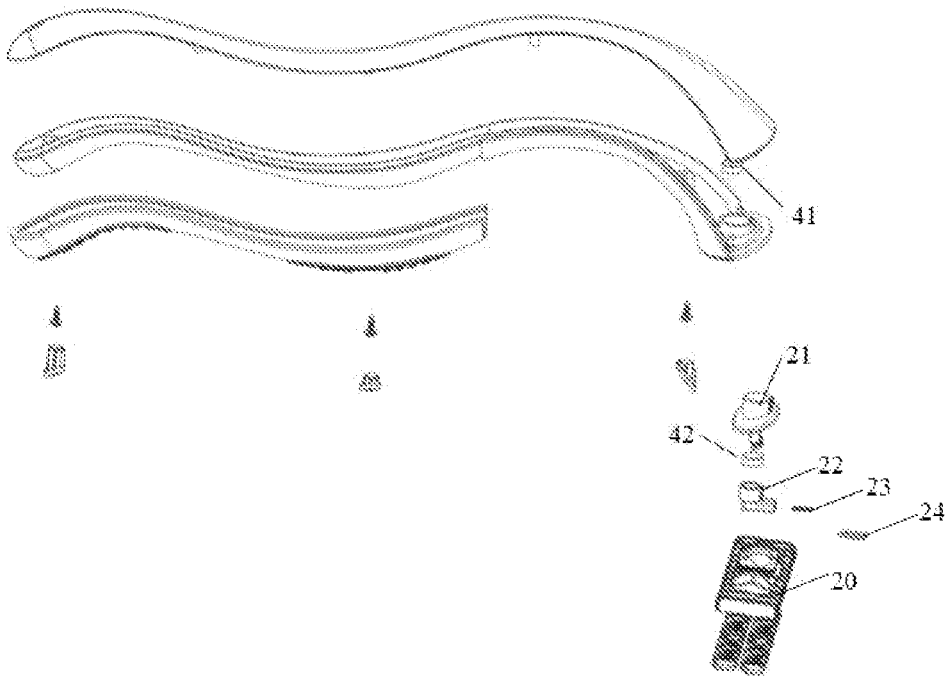
FIG. 9 is a schematic exploded view of a shaving razor according to an embodiment of the present application.

The structure of the blade holder assembly 2 will be specifically described with reference to FIG. 9. The blade holder assembly 2 includes a blade holder body 20 and a first movable body 21, the first movable body 21 is provided behind the blade holder body 20, the first movable body 21 is connected with a front end of the handle assembly 1, and a guiding portion 210 on the first movable body 21 is slidably connected with a guiding plate 201 on a back side of the blade holder body 20; and when a front side of the blade holder assembly 2 is not stressed uniformly, the blade holder assembly 2 swings relative to the handle assembly 1, and the guiding plate 201 slides relative to the guiding portion 210.

In actual use, under the action of the external force, the guiding portion 210 is slidable along the guiding plate 201, thereby driving the handle assembly 1 to rotate relative to the blade holder assembly 2, and adjusting an included angle between the handle assembly 1 and the blade holder assembly 2. The guiding plate 201 is of an arc shape, and the included angle between the handle assembly 1 and the blade holder assembly 2 is in a range of 0-24°. In order to reset the blade holder assembly 2, the blade holder assembly 2 further includes a second movable body 22 and an elastic assembly, one end of the second movable body 22 is connected with the first movable body 21, the other end of the second movable body 22 abuts against one end of the elastic assembly, and the other end of the elastic assembly is movably connected with the blade holder body 20; after the second movable body 22 is stressed by a pushing force from the first movable body 21, the first movable body 21 compresses the elastic assembly, such that the guiding portion 210 slides along the guiding plate 201 in a first direction; and after the pushing force is released, the elastic assembly is recovered, such that the guiding portion 210 slides along the guiding plate 201 in a second direction. The first direction and the second direction are opposite to each other. The first direction is a direction in which the guiding portion 210 is close to an outer end surface of the blade holder assembly 2. In actual applications, with FIG. 5 as an example, the first direction is a clockwise direction, while the second direction is a counterclockwise direction.

In the embodiment, the first movable body 21 is stressed by the pushing force of the handle assembly 1, such that the guiding portion 210 on the first movable body 21 slides along the guiding plate 201 to adjust the included angle between the handle assembly 1 and the blade holder assembly 2; and meanwhile, the first movable body 21 further conducts the pushing force to the second movable body 22, such that the second movable body 22 compresses the spring to generate an appropriate resistance, thereby preventing the blade holder assembly 2 from moving too fast and ensuring the desirable shaving effect. After the pushing force is released, the elastic assembly is recovered, such that the guiding portion 210 slides reversely along the guiding plate 201 to an original state, and an end portion of the second holding portion 12 falls into a plane where the blade holder assembly 2 is located, thereby making the shaving razor stored easily.

The structure of each of the first movable body 21, the second movable body 22, the ejector rod 24 and the blade holder body 20, and the connection relationship between the components will be described below in combination with FIG. 10 to FIG. 14.

Figure 10:
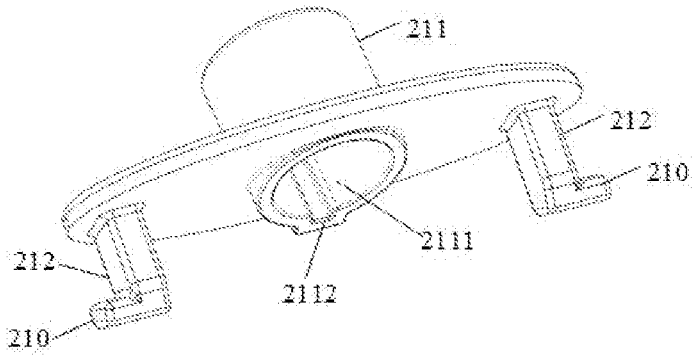
FIG. 10 is a schematic structural view of a first movable body according to an embodiment of the present application.

As shown in FIG. 10, a first fixed post 211 is provided on the first movable body 21, the handle assembly 1 is sleeved on the first fixed post 211, two sides of the first fixed post 211 each is provided with a guiding arm 212, and an end portion of the guiding arm 212 is provided with the guiding portion 210 bending toward the guiding plate 201. With FIG. 4 as an example, the guiding arm 212 is provided between two guiding plates 201, and the end portion of the guiding arm 212 is provided with the guiding portion 210 bending outward. Certainly, in other embodiments, the two guiding plates 201 may be arranged between two guiding arms 212; and in this case, the end portion of each of the guiding arms 212 is provided with the guiding portion 210 bending inward, and a guiding groove will be provided cooperatively.

Figure 11:
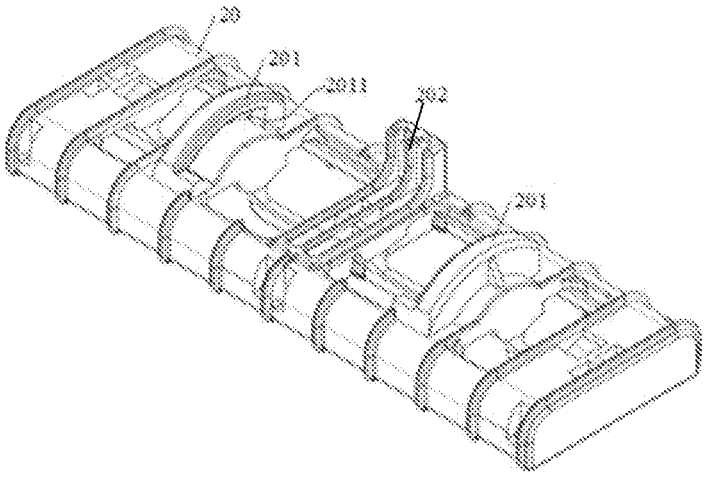
FIG. 11 is a schematic structural view of a blade holder body according to an embodiment of the present application.

As shown in FIG. 11, the blade holder body 20 includes two opposite guiding plates 201, a guiding groove 2011 is formed in each of the guiding plates, and the guiding portion 210 is hooked in the guiding groove 2011. The guiding groove 2011 may be the through groove (transversely penetrating through the guiding plate 201), and may also not be the through groove (not transversely penetrating through the guiding plate 201) and may be provided specifically as the case may be.

Figure 12:
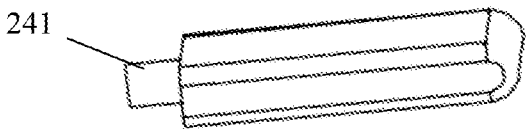
FIG. 12 is a schematic structural view of an ejector rod according to an embodiment of the present application.

As shown in FIG. 12, the elastic assembly includes an elastomer 23 and an ejector rod 24. The elastomer 23 may be a spring, a first end of the ejector rod 24 is provided with a convex post 241, one end of the elastomer 23 is sleeved on the convex post 241, and the other end of the elastomer 23 is provided in the first movable body 21. As shown in FIG. 11, a limiting portion 202 is provided on the blade holder body 20, and a second end of the ejector rod 24 is movably connected with the limiting portion 202. The ejector rod 24 may abut against the limiting portion 202, or, the ejector rod 24 may also be coupled or hinged to the limiting portion 202, which may be designed specifically as the case may be, provided that the ejector rod 24 can rotate relative to the limiting portion 202. In an optional embodiment, two grooves (not shown) are formed in the blade holder body 20, and an end portion of a sidewall shared by the two grooves is the limiting portion 202. By providing the two grooves to form the limiting portion 202, the weight of the blade holder body 20 can be reduced to make the shaving razor more portable.

Figure 13:
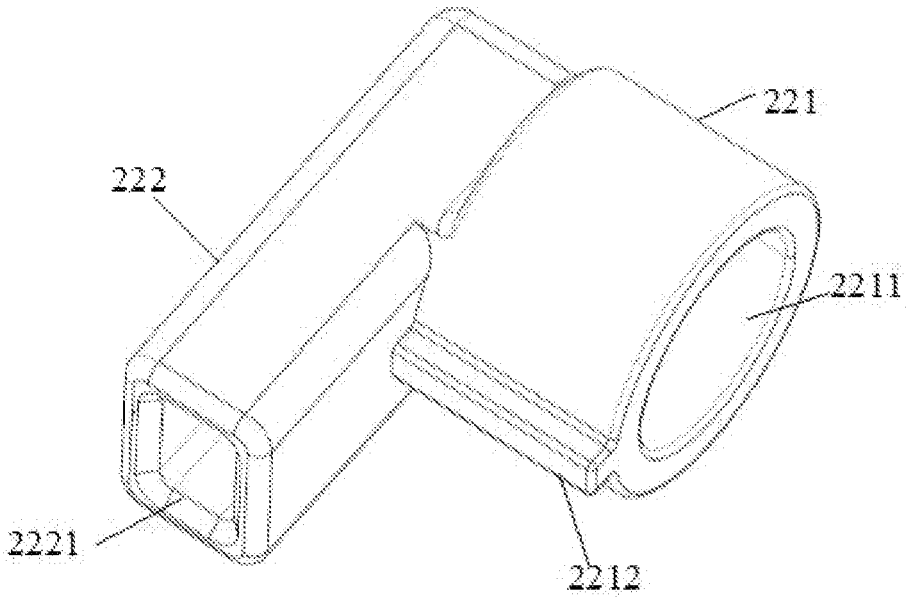
FIG. 13 is a schematic structural view of a second movable body according to an embodiment of the present application.
Figure 14:
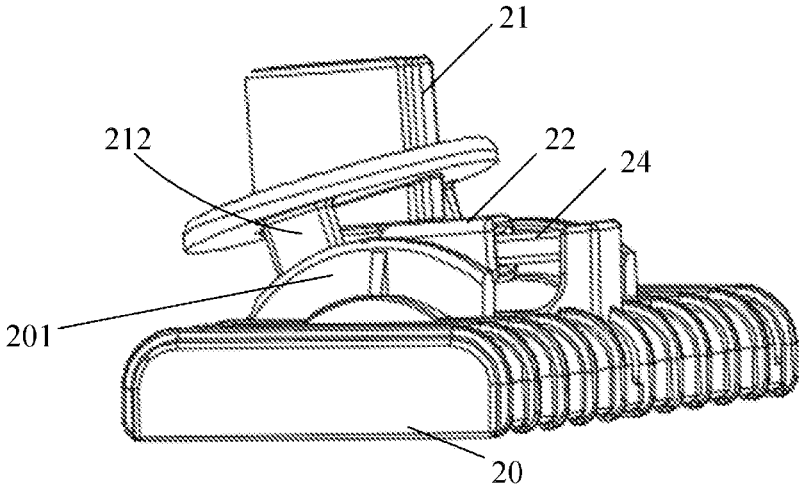
FIG. 14 is a schematic structural view of a blade holder assembly according to an embodiment of the present application.

Referring also to FIG. 10 and FIG. 13, a first accommodation hole 2111 is formed in the first fixed post 211, the second movable body 22 includes a second fixed post 221, and the second fixed post 221 is placed in the first accommodation hole 2111. An edge of the first accommodation hole 2111 is convexly provided with a locating groove 2112 outward, and an edge of the second fixed post 221 is convexly provided with a locating strip 2212 outward. The locating strip 2212 is placed in the locating groove 2112 to prevent rotation of the second fixed post 221. The second movable body 22 includes a push rod 222. An axis of the push rod 222 is perpendicular to that of the second fixed post 221, namely the push rod 222 and the second fixed post 221 are of an "L" shape. A second accommodation hole 2221 is formed in the push rod 222, and the elastomer 23 is placed in the second accommodation hole 2221. In actual use, under the action of the external force, the sidewall of the push rod 222 compresses the spring to facilitate the rotation. According to the foregoing description, components such as the first movable body 21, the second movable body 22, the ejector rod 24 and the blade holder body 20 are connected together to form the blade holder assembly shown in FIG. 14.

The handle assembly 1 is provided thereon with the first magnetic body 41, while the blade holder assembly 2 is provided thereon with the second magnetic body 42; and the first magnetic body 41 and the second magnetic body 42 are opposite in magnetism, such that the blade holder assembly 2 is detachably fixed on the handle assembly 1 through the magnetic force. The first magnetic body 41 and the second magnetic body 42 each may be a magnet. Specifically, as shown in FIG. 13, a third accommodation hole 2211 is formed in the second fixed post 221, and the second magnetic body 42 is placed in the third accommodation hole 2211. When the first movable body 21 is sleeved on the second movable body 22, the second magnetic body 42 is restricted in a space formed by the first movable body 21 and the second movable body 22; and when the handle assembly 1 is sleeved on the second movable assembly 22, the first magnetic body 41 and the second magnetic body 42 are attracted to each other, such that the blade holder assembly 2 is detachably fixed on the handle assembly 1 through the magnetic force.

As the handle assembly 1 can rotate relative to the blade holder assembly 2, the user can shave excessive hair freely without finding an appropriate angle deliberately, thereby improving the ease of operation for the user and the comfort in use. Moreover, during the shaving, the blade holder assembly 2 is always attached to the skin of the body to prevent the blade set 3 from scratching the kin.

The foregoing is merely an implementation of the present application and does not constitute a limitation on the scope of the present patent application. Any equivalent structure or equivalent process change made by using the description and the accompanying drawings of the present application, or direct or indirect application thereof in other related technical fields, shall still fall in the protection scope of the patent of this application.

What is claimed is:

1. A shaving razor, comprising a handle assembly, a blade holder assembly and at least one blade set, wherein the blade holder assembly comprises a blade holder body, a first body, a second body and an elastic assembly, an accommodation groove is formed in the blade holder body, the at least one blade set is embedded into the accommodation groove, and a discharge port is formed in a back of the blade holder body and is in communication with the accommodation groove;

the first body is connected with the handle assembly, and a guiding portion on the first body is slidably connected with a guiding plate on the blade holder body; and under action of external forces, the guiding portion is slidable along the guiding plate, thereby driving the handle assembly to rotate relative to the blade holder body;

one end of the second body is connected with the first body, the other end of the second body abuts against one end of the elastic assembly, and the other end of the elastic assembly is movably connected with the blade holder body; and after the second body is stressed by the external forces from the first body, the elastic assembly is compressed, such that the guiding portion slides along the guiding plate in a first direction; and after the external forces are released, the elastic assembly is recovered, such that the guiding portion slides along the guiding plate in a second direction, the first direction being opposite to the second direction.

2. The shaving razor according to claim 1, wherein at least two engageable portions are arranged on the accommodation groove, the at least two engageable portions are opposite to each other, and the engageable portions each are configured to fix the blade set on the blade holder body.

3. The shaving razor according to claim 2, wherein the at least two engageable portions are four engageable portions, and the engageable portions are arranged at four corners of the accommodation groove, respectively.

4. The shaving razor according to claim 1, wherein a first fixed post is provided on the first body, the handle assembly is sleeved on the first fixed post, two sides of the first fixed post each is provided with a guiding arm, and two guiding portions are respectively arranged on an end portion of the guiding arm bending toward the guiding plate.

5. The shaving razor according to claim 1, wherein the handle assembly comprises a first holding portion and a second holding portion, the first holding portion is located between the blade holder assembly and the second holding portion, the first holding portion and the second holding portion each is of an arc shape, and opening directions of the first holding portion arc shape and the second holding portion arc shape are opposite to each other.

6. The shaving razor according to claim 5, wherein a first rough portion is provided on the first holding portion, and a second rough portion is provided on the second holding portion.

7. The shaving razor according to claim 1, wherein multiple protective convex ribs are arranged on the blade holder body, the multiple protective convex ribs are sequentially arranged along a width direction of the blade holder body, the protective convex ribs each extend along a length direction of the blade holder body, and an end portion of each of the protective convex ribs is protruded out of an edge of the blade holder body.

* * * * *